US005303307A

United States Patent [19]

Elko et al.

[11] Patent Number: 5,303,307

[45] Date of Patent: Apr. 12, 1994

[54] ADJUSTABLE FILTER FOR DIFFERENTIAL MICROPHONES

[75] Inventors: Gary W. Elko, Summit; Robert A. Kubli, Milford; Dennis R. Morgan, Morristown; James E. West, Plainfield, all of N.J.

[73] Assignee: AT&T Bell Laboratories, Murray Hill, N.J.

[21] Appl. No.: 35,551

[22] Filed: Mar. 23, 1993

Related U.S. Application Data

[63] Continuation of Ser. No. 731,560, Jul. 17, 1991.

[51] Int. Cl.[5] ..... H04R 3/00

[52] U.S. Cl. ..... 381/92

[58] Field of Search ..... 381/92, 94, 111, 98

[56] References Cited

U.S. PATENT DOCUMENTS

| | | | |
|---|---|---|---|
| 4,354,059 | 10/1982 | Ishigaki et al. | 381/92 |
| 4,393,275 | 7/1983 | Feldman et al. | 179/1 |
| 4,412,097 | 10/1983 | Ishigaki et al. | 381/92 |
| 4,589,136 | 5/1986 | Poldy et al. | 381/94 |
| 4,741,038 | 4/1988 | Elko et al. | 381/92 |
| 4,752,961 | 6/1988 | Kahn | 381/92 |
| 4,870,690 | 9/1989 | Negishi et al. | 381/103 |
| 4,941,187 | 7/1990 | Slater | 381/94 |
| 5,214,709 | 5/1993 | Ribic | 381/92 |

FOREIGN PATENT DOCUMENTS

| | | | |
|---|---|---|---|
| 379274 | 12/1983 | Fed. Rep. of Germany . | |
| 3630692 | 9/1986 | Fed. Rep. of Germany . | |
| 60-194900 | 10/1985 | Japan | 381/92 |

OTHER PUBLICATIONS

A. E. Robertson, *Microphones*, 8–29 and 171–200 (1963).

H. F. Olson, *Modern Sound Reproduction*, 67–104 (1972).

W. A. Beaverson and A. M. Wiggins, *A Second-Order Gradient Noise Cancelling Microphone Using A Single Diaphragm*, vol. 22, No. 5, J. Acoust. Soc. Am., 592–601 (1950).

A. J. Brouns, *Second-Order Gradient Noise-Cancelling Microphone*, ICASSP, 786–789 (1981).

V. Viswanathan et al., *Evaluation of Multisensor Speech Input for Speech Recognition in High Ambient Noise*, ICASSP, 85–88 (1986).

G. M. Sessler and J. E. West, *First-Order Gradient Microphone Based on the Foil-Electret Principle: Discrimination Against Air-Borne and Solid-Borne Noises*, vol. 46, No. 5 (Part 1), J. Acoust. Soc. Am., 1081–86 (1969).

J. L. Flanagan, *Speech Analysis Synthesis and Perception*, 38–41 (1972).

*Primary Examiner*—Forester W. Isen

*Attorney, Agent, or Firm*—Thomas A. Restaino

[57] ABSTRACT

A method and apparatus for providing a differential microphone with a desired frequency response are disclosed. The desired frequency response is provided by operation of a filter, having an adjustable frequency response, coupled to the microphone. The frequency response of the filter is set by operation of a controller, also coupled to the microphone, based on signals received from the microphone. The desired frequency response may be determined based upon the distance between the microphone and a source of sound, and may comprise both a relative frequency response and absolute output level. The frequency response of the filter may comprise the substantial inverse of the frequency response of the microphone to provide a flat response. Furthermore, the filter may comprise a Butterworth filter.

38 Claims, 6 Drawing Sheets

ADJUSTABLE FILTER FOR DIFFERENTIAL MICROPHONES

This application is a continuation of application Ser. No. 07/731,560, filed on Jul. 17, 1991.

FIELD OF THE INVENTION

This invention relates generally to differential microphones and more specifically to adjusting the frequency response of differential microphones to provide a desired response.

BACKGROUND OF THE INVENTION

Directional microphones offer advantages over omnidirectional microphones in noisy environments. Unlike omnidirectional microphones, directional microphones can discriminate against both solid-borne and air-borne noise based on the direction from which such noise emanates, defined with respect to a reference axis of the microphone. Differential microphones, sometimes referred to as gradient microphones, are a class of directional microphones which offer the additional advantage of being able to discriminate between sound which emanates close to the microphone and sound emanating at a distance. Since sound emanating at a distance is often classifiable as noise, differential microphones have use in the reduction of the deleterious effects of both off-axis and distant noise.

Differential microphones are microphones which have an output proportional to a difference in measured quantities. There are several types of differential microphones including pressure, velocity and displacement differential microphones. An exemplary pressure differential microphone may be formed by taking the difference of the output of two microphone sensors which measure sound pressure. Similarly, velocity and displacement differential microphones may be formed by taking the difference of the output of two microphone sensors which measure particle velocity and diaphragm displacement, respectively. Differential microphones may also be of the cardioid type, having characteristics of both velocity and pressure differential microphones.

As a general matter, differential microphones exhibit a frequency response which is a function of the distance between the microphone and the source of sound to be detected (e.g., speech). For example, when a pressure differential microphone is located in the near field of a speech source (that area of the sound field exhibiting a large spatial gradient and a large phase shift between acoustic pressure and particle velocity, e.g., less than 2 cm. from the source), its frequency response is essentially flat over some specified frequency range. At somewhat greater distances from the speech source, the frequency response tends to over-emphasize high frequencies. When a velocity differential microphone is in the near field of a speech source, its frequency response tends to over-emphasize low frequencies, while at somewhat greater distances, its response is essentially flat for some specified frequency range.

Because their frequency response varies with distance, differential microphones are ideally suited for use at a constant distance from a source, for example, at a distance where microphone response is flat. In practice, however, users of pressure differential microphones often vary the distance between microphone and mouth over time, causing the microphone to exhibit an undesirable, variable gain to certain frequencies present in speech. For a pressure differential microphone, unless a close constant distance is maintained, high frequencies present in speech will be emphasized. For a velocity differential microphone, unless somewhat greater distances are maintained, lower frequencies will be emphasized.

SUMMARY OF THE INVENTION

A method and apparatus are disclosed for providing a desired frequency response of a differential microphone of order n. A desired response is provided by operation of a controller in combination with an adjustable filter. The controller receives microphone output and determines, based on the output, a filter frequency response needed to provide any desired response. For example, the controller may determine a filter frequency response which equals or approximates the inverse of the microphone response to provide an overall flat response. Alternatively, an exemplary response could be provided which is optimal for telephony. The determination by the controller can include a complete definition of the filter response (including absolute output level) or a definition of just those parameters used in modifying one or more aspects of a given or quiescent response. The filter is adjusted by the controller to exhibit the determined frequency response thereby providing a desired response for the microphone.

In an illustrative embodiment of the present invention for a pressure differential microphone, the controller makes an automatic determination of distance between microphone and sound source (this distance being referred to as the "operating distance") and adjusts a low-pass filter to compensate for the gain to high frequencies exhibited by the microphone at or about the determined distance. The operating distance may be determined one or more times (e.g., periodically) during microphone use. Automatic distance determination may be accomplished by comparing observed microphone output at an unknown operating distance to known outputs at known distances.

In the illustrative embodiment, the frequency response of the low-pass filter is dependent upon the frequency response of the pressure differential microphone as a function of operating distance and microphone order. Pressure differential microphones have a frequency response which is flat at close operating distances and at large operating distances increases at a rate of 6 n dB per doubling of frequency (i.e., per octave), where n is an integer equal to the order of the pressure differential microphone. For a given determined distance, the filter frequency response is adjusted, and this may include an adjustment to absolute output level.

In the case of the illustrative embodiment for use with a first or second order pressure differential microphone, the filter is a first or second order Butterworth low-pass filter, respectively, with a half-power frequency adjustable to the microphone's 3 dB gain frequency, which is a function of operating distance.

DETAILED DESCRIPTION

Introduction

Figure 1:
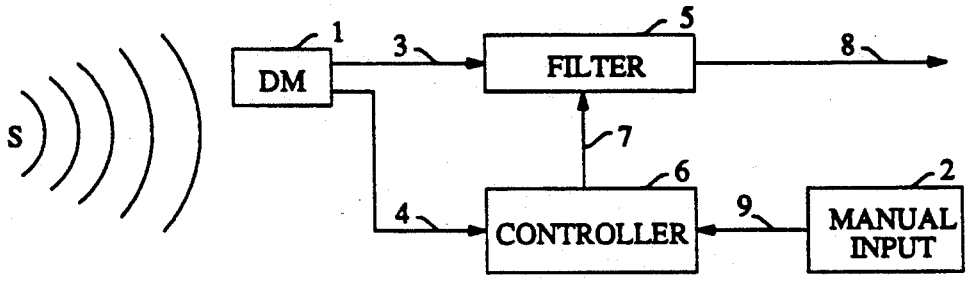
FIG. 1 presents an exemplary block diagram embodiment of the present invention.

FIG. 1 presents an illustrative embodiment of the present invention. In FIG. 1, a differential microphone 1 of order n provides an output 3 to a filter 5. Filter 5 is adjustable (i.e., selectable or tunable) during microphone use. A controller 6 is provided to adjust the filter frequency response. The controller 6 can be operated via a control input 9.

In operation, the controller 6 receives from the differential microphone 1 output 4 which is used to determine the operating distance between the differential microphone 1 and the source of sound, S. Operating distance may be determined once (e.g., as an initialization procedure) or multiple times (e.g., periodically). Based on the determined distance, the controller 6 provides control signals 7 to the filter 5 to adjust the filter to the desired filter frequency response. The output 3 of the differential microphone 1 is filtered and provided to subsequent stages as filter output 8.

Frequency Response of Pressure Differential Microphones

One illustrative embodiment of the present invention involves pressure differential microphones. In general, the frequency response of a pressure differential microphone of order n ("PDM(n)") is given in terms of the nth derivative of acoustic pressure, $p=P_o e^{-jkr}/r$, within a sound field of a point source, with respect to operating distance, where $P_o$ is source peak amplitude, k is the acoustic wave number ($k=2\pi/\lambda$, where $\lambda$ is wavelength and $\lambda=c/f$, where c is the speed of sound and f is frequency in Hz), and r is the operating distance. That is, $$\frac{d^n p}{dr^n} = P_o \frac{n!}{r^{n+1}} e^{-jkr} (-1)^n \sum_{m=0}^{n} \frac{(jkr)^m}{m!}, \quad (1)$$

Figure 2:
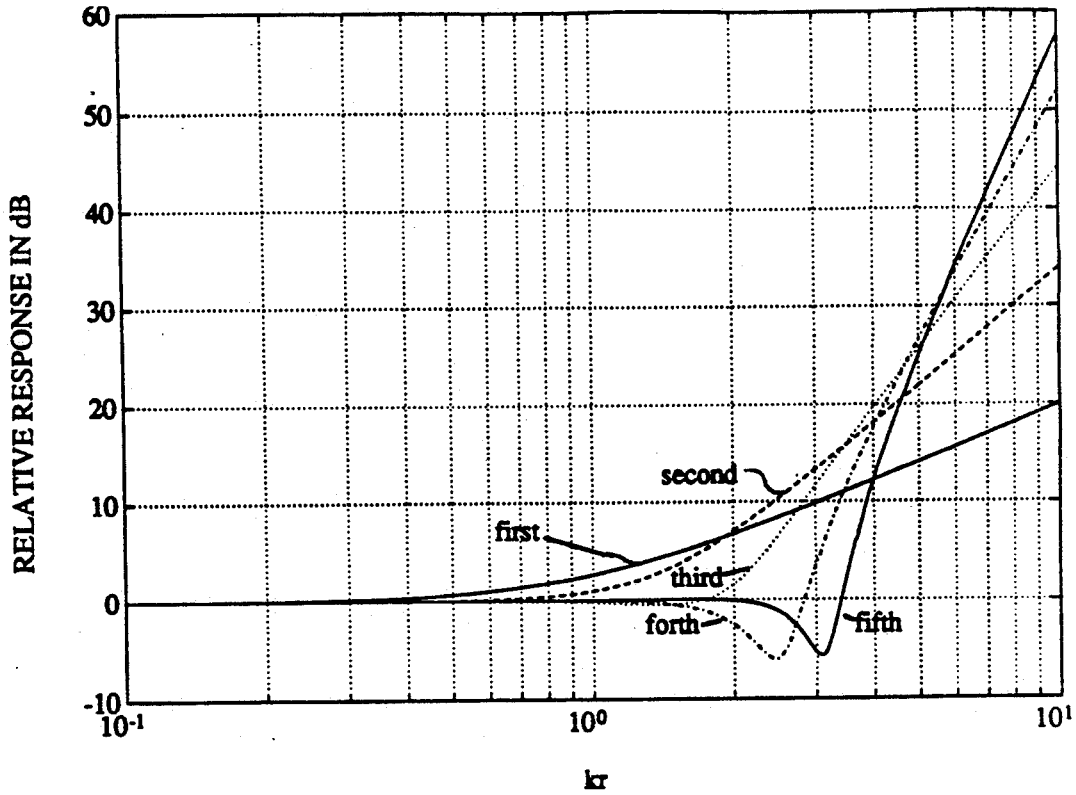
FIG. 2 presents a relative frequency response plat of first through fifth order pressure differential microphones as a function of kr, where k is the acoustic wave number and r is the operating distance to a source.

FIG. 2 presents a plot of the magnitude of Eq. 1 for n=1 to 5. The figure shows the gain exhibited by a PDM(n), n=1 to 5, at high frequencies and large distances, i.e., at increasing values of kr.

For purposes of this discussion, it is instructive to examine the frequency response of a PDM as a function of kr. Therefore, two illustrative developments are provided below. The developments address the frequency response of both first and second order PDMs as functions of kr, and are made in terms of a finite difference approximation for $$\frac{d^n p}{dr^n}.$$

In light of Eq. 1 and the developments which follow, it will be apparent to the ordinary artisan that the analysis can be extended in a straight-forward fashion to any order PDM. Also, because the response of velocity and displacement microphones is related to that of a pressure differential microphone by factors of $1/j\omega$ and $1/(j\omega)^2$, respectively, the ordinary artisan will recognize that Eq. 1 and the developments which follow are adaptable to systems employing velocity and displacement differential microphones, as well as cardioid microphones.

First Order Pressure Differential Microphones

Figure 3:
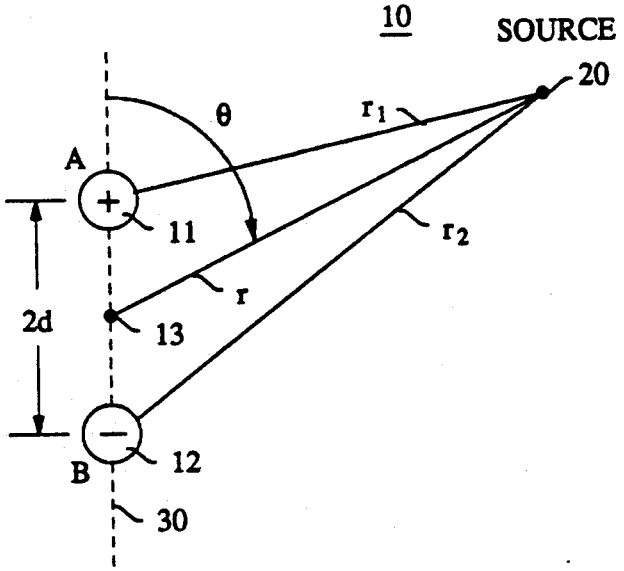
FIG. 3 presents a schematic view of a first order pressure differential microphone in relation to a point source of sound.

A schematic representation of a first order PDM in relation to a source of sound is shown in FIG. 3. The microphone 10 typically includes two sensing features: a first sensing feature 11 which responds to incident acoustic pressure from a source 20 by producing a positive response (typically, a positively tending voltage), and a second sensing feature 12 which responds to incident acoustic pressure by producing a negative response (typically, a negatively tending voltage). These first and second sensing features 11 and 12 may be, for example, two pressure (or "zeroth" order) microphones. The sensing features are separated by an effective acoustic distance 2*d*, such that each sensing feature is located a distance d from the effective acoustic center 13 of the microphone 10. A point source 20 is shown to be at an operating distance r from the effective acoustic center 13 of the microphone 10, with the first and second sensing features located at distances $r_1$ and $r_2$, respectively, from the source 20. An angle $\theta$ exists between the direction of sound propagation from the source 20 and the microphone axis 30.

For a spherical wave generated by source 20 at operating distance r from the center 13 of the microphone 10, the acoustic pressure incident on the first sensing feature 11 is given by:

$$p_1 = \frac{P_0 e^{-jkr1}}{r_1}. \quad (2a)$$

The acoustic pressure incident on the second sensing feature 12 is given by:

$$p_2 = \frac{P_0 e^{-jkr2}}{r_2}. \quad (2b)$$

The distances $r_1$ and $r_2$ are given by the following expressions:

$$r_1 = \sqrt{r^2 + d^2 - 2rd\cos\theta}\,, \tag{3a}$$

$$r_2 = \sqrt{r^2 + d^2 + 2rd\cos\theta}\,. \tag{3b}$$

If r>>d (when the microphone is in the far field of source 20) or $\theta \approx 0°$ (when source 20 is located near microphone axis 30), then $$r_1 \approx r - d\cos\theta \tag{4a}$$

and $$r_2 \approx r + d\cos\theta \tag{4b}$$

The response of the microphone can then be approximated by a first-order difference of acoustic pressure, Δp, and is given by:

$$\Delta p = p_1 - p_2 \approx \tag{5}$$

$$\frac{2P_0\, e^{-jkr}}{r^2 - d^2\cos^2\theta}\,[d\cos\theta\cos(kd\cos\theta) + jr\sin(kd\cos\theta)]$$

The magnitude of Δp, |Δp|, is:

$$|\Delta p| \approx \tag{6}$$

$$\frac{2P_0}{r^2 - d^2\cos^2\theta}\sqrt{d^2\cos^2\theta\cos^2(kd\cos\theta) + r^2\sin^2(kd\cos\theta)}\,.$$

For kd<<1, $$\sin(kd\cos\theta) \approx kd\cos\theta, \tag{7}$$

and $$\cos(kd\cos\theta) \approx 1. \tag{8}$$

Therefore, $$\Delta p \approx \frac{2P_0\, e^{-jkr}\, d\cos\theta}{r^2 - d^2\cos^2\theta}\,[1 + jkr], \tag{9}$$

and $$|\Delta p| \approx \frac{2P_0 d|\cos\theta|}{r^2 - d^2\cos^2\theta}\sqrt{1 + k^2r^2}\,. \tag{10}$$

For a near-field source, i.e., kr<<1, $$|\Delta p| \approx \frac{2P_0 d|\cos\theta|}{r^2 - d^2\cos^2\theta}\,, \tag{11}$$

and for a far-field source, i.e., kr>>1 and r>>d, $$|\Delta p| \approx \frac{2P_0 kd|\cos\theta|}{r}\,. \tag{12}$$

Figure 4:
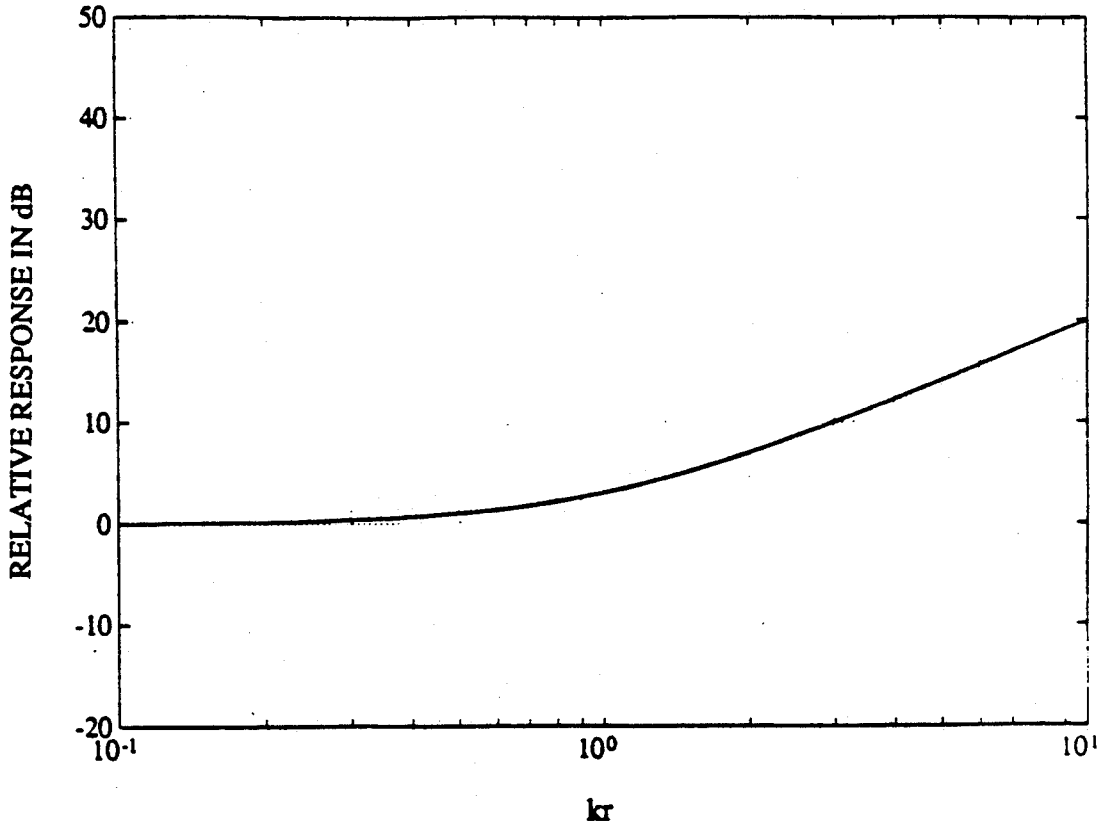
FIG. 4 presents a relative frequency response plot for a first order pressure differential microphone as a function of kr.

Note that Eq. 11 contains no frequency dependent terms. That is, Eq. 11 is independent of the wave number, k (wave number is proportional to frequency, i.e., $$k = \frac{2\pi}{c}f,$$

where f is frequency in Hz and c is the speed of sound). As such, a first order PDM in the near field of a point source 20 has a frequency response which is substantially flat. On the other hand, Eq. 12 does depend on the acoustic wave number, k. FIG. 4 shows the frequency dependence of the first order PDM for values of kr from 0.1 to 10. For values of kr<0.2 the response is substantially uniform or flat. Above kr=1.0 the response rises at 6 dB per doubling kr. (For this figure, kd<<1 and r>>d.)

Second Order Pressure Differential Microphones

Figure 5:
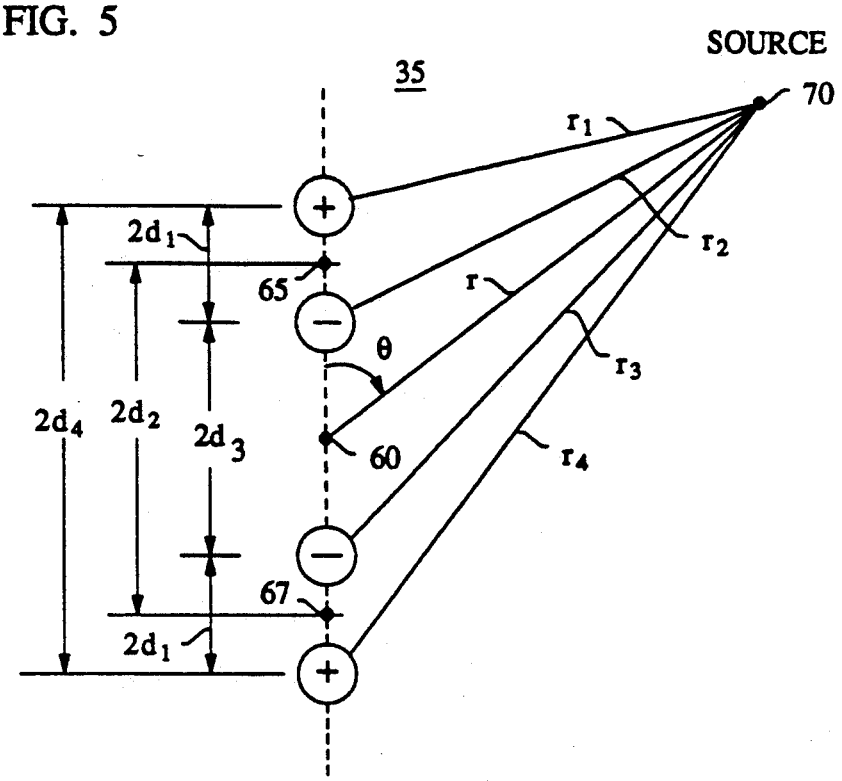
FIG. 5 presents a schematic view of a second order pressure differential microphone in relation to a point source of sound.

A second order PDM is formed by combining two first order PDMs in opposition. Each first order PDM can have a spacing of $2d_1$ and an acoustic center 65,67. The PDMs can be arranged in line and spaced a distance $2d_2$ apart as shown in FIG. 5. The response of the second order PDM can be approximated by a second order difference of acoustic pressure, $\Delta^2p$, in a sound field of a spherical radiating source 70 at operating distance r from the acoustic center 60 of the microphone 35:

$$\Delta^2 p = p_1 - p_2 - p_3 + p_4 \tag{13}$$

where $$p_i = \frac{P_0\, e^{-jkri}}{r_i}\,; \tag{14}$$

and $r_i$, for i=1 to 4 are:

$$r_1 = \sqrt{r^2 + d_4^2 - 2rd_4\cos\theta}\,; \tag{15}$$

$$r_2 = \sqrt{r^2 + d_3^2 - 2rd_3\cos\theta}\,; \tag{16}$$

$$r_3 = \sqrt{r^2 + d_3^2 + 2rd_3\cos\theta}\,; \tag{17}$$

and $$r_4 = \sqrt{r^2 + d_4^2 + 2rd_4\cos\theta}\,. \tag{18}$$

If $r >> d_3$ and $r >> d_4$ or $\theta \approx 0°$, then:

$$r_1 \approx r - d_4\cos\theta; \tag{19}$$

$$r_2 \approx r - d_3\cos\theta; \tag{20}$$

$$r_3 \approx r + d_3\cos\theta; \tag{21}$$

and $$r_4 \approx r + d_4\cos\theta. \tag{22}$$

Therefore, $$\Delta^2 p \approx 2P_0\, e^{-jkr}\left[\frac{r\cos(kd_4\cos\theta) + jd_4\cos\theta\sin(kd_4\cos\theta)}{r^2 - d_4^2\cos^2\theta} - \right. \tag{23}$$

-continued $$\frac{r\cos(kd_3\cos\theta) + jd_3\cos\theta\sin(kd_3\cos\theta)}{r^2 - d_3^2\cos^2\theta}\Bigg]$$

For $kd_4<1$, $$\cos(kd_4\cos\theta) \approx 1 - \frac{k^2d_4^2\cos^2\theta}{2} \tag{24}$$

and $$\sin(kd_4\cos\theta) \approx kd_4\cos\theta. \tag{25}$$

Equations similar to Eqs. 24 and 25 can be written for $\cos(kd_3\cos\theta)$ and $\sin(kd_3\cos\theta)$ when $kd_3<<1$. For $kd_4<<1$ and $kd_3<<1$ then:

$$\Delta^2 p \approx \frac{4P_0d_1d_2r\cos^2\theta\, e^{-jkr}[2 - k^2r^2 + 2jkr]}{(r^2 - d_4^2\cos^2\theta)(r^2 - d_3^2\cos^2\theta)}, \tag{26}$$

and $$|\Delta^2 p| \approx \frac{4P_0d_1d_2r\cos^2\theta\sqrt{4 + k^4r^4}}{(r^2 - d_4^2\cos^2\theta)(r^2 - d_3^2\cos^2\theta)}. \tag{27}$$

, For a near-field source ($kr<<1$), $$|\Delta^2 p| \approx \frac{8P_0d_1d_2r\cos^2\theta}{(r^2 - d_4^2\cos^2\theta)(r^2 - d_3^2\cos^2\theta)}; \tag{28}$$

and for a far-field source ($kr>>1$; $r>>d_3$; $r>>d_4$), $$|\Delta^2 p| \approx \frac{4P_0d_1d_2k^2\cos^2\theta}{r}. \tag{29}$$

As is the case with Eq. 11, Eq. 28 contains no frequency dependent terms. Thus, a second order PDM 35 in the near field of a point source 70 has a frequency response which is flat. Like Eq. 12, Eq. 29 does depend on frequency. However, Eq. 29 exhibits a rise in response at high frequencies at twice the rate of that exhibited by Eq. 12.

Figure 6:
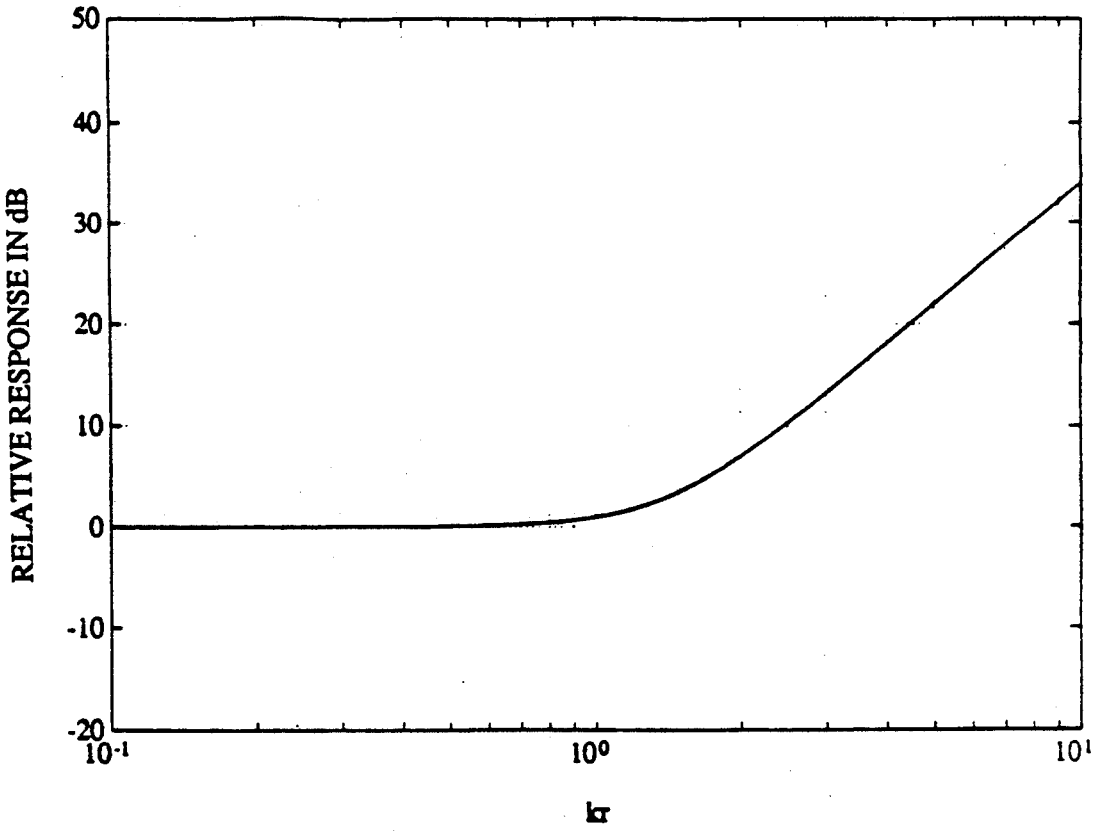
FIG. 6 presents a relative frequency response plot for a second order pressure differential microphone as a function of kr.

FIG. 6 shows the relative frequency response of a second order PDM versus kr. For $kr<1$, the response is substantially flat. Above $kr=1$, the response rises at 12 dB per doubling of kr. (For this Figure, $kd_3<<1$ and $kd_4<<1$ and $r>>d_3$ and $r>>d_4$, for a far field source, or $\theta\approx 0°$.)

Automatic Distance Determination

The illustrative embodiment of the present invention includes an automatic determination of operating distances by the controller 6. This embodiment facilitates determining operating distance continuously or at periodic or aperiodic points in time.

For a first order PDM, the controller 6 can use ratios of output levels from two zeroth order PDMs (of the first order PDM) to estimate the operating distance between source and microphone. This approach involves making a predetermined association between ratios of zeroth order PDM output levels and operating distances at which such ratios are found to occur. At any time during microphone operation, a ratio of zeroth order PDM output levels can be compared to the predetermined ratios at known distances to determine the then current operating distance.

Consider the first order PDM 75 which comprises zeroth order PDMs A 11 and B 12 shown in FIG. 3. The response of zeroth order PDMs A 11 and B 12 can be written (from Eqs. 2a and 2b) as $$p_A = \frac{P_0e^{-jkr1}}{r_1} \tag{30}$$

and $$p_B = \frac{P_0e^{-jkr2}}{r_2}. \tag{31}$$

Using Eqs 4a,b, Eqs. 30 and 31 can be rewritten as follows:

$$p_A \approx \frac{P_0e^{-jk(r-d\cos\theta)}}{r - d\cos\theta} \tag{32}$$

and $$p_B = \frac{P_0e^{-jk(r+d\cos\theta)}}{r + d\cos\theta}. \tag{33}$$

The magnitude of the response of the microphones A 11 and B 12 (for $r>d|\cos\theta|$) is therefore:

$$|p_A| \approx \frac{P_0}{|r - d\cos\theta|} \tag{34}$$

and $$|p_B| \approx \frac{P_0}{|r + d\cos\theta|}. \tag{35}$$

Figure 7:
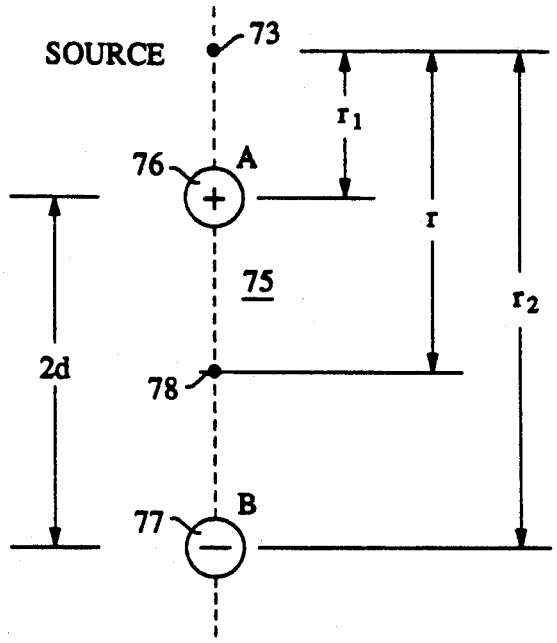
FIG. 7 presents a schematic view of a first order pressure differential microphone in relation to an on-axis point source of sound.

For an illustrative configuration of FIG. 7, $\theta=0$ and the ratio of Eqs. 34 and 35 is:

$$A_r = \frac{|p_A|}{|p_B|} = \frac{r + d}{r - d}. \tag{36}$$

Ratio $A_r$ is a function of operating distance r (between source 73 and microphone acoustic center 78) and d, a physical parameter of the PDM design. For a given first order PDM, the parameter d is fixed such that $A_r$ varies with r only.

Figure 8:
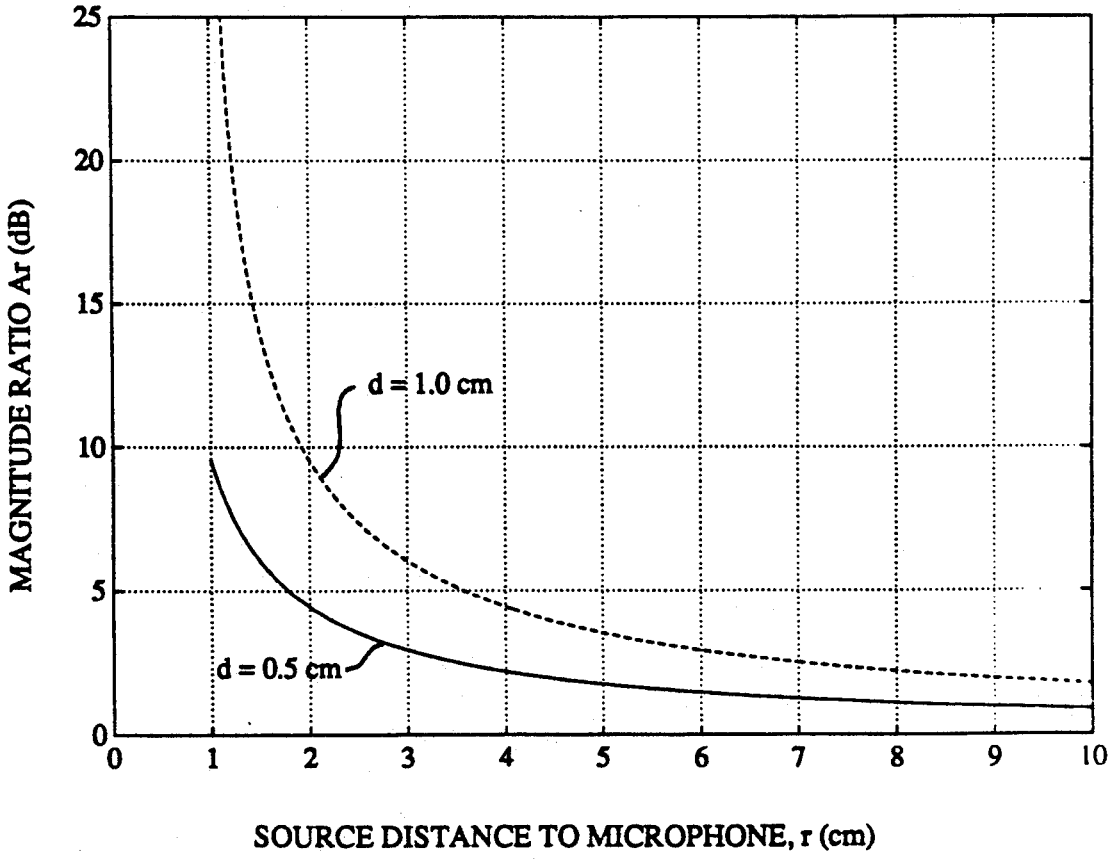
FIG. 8 presents sound pressure level ratio plots for two zeroth order pressure differential microphones which form a first order pressure differential microphone.

A plot of $A_r$ (Eq. 36) for two exemplary first order PDM array configurations ($d=1$ cm and $d=2$ cm) is shown in FIG. 8. The figure shows that changes in $A_r$ are sizeable for a range of r. With knowledge of this data, operating distances for measured $A_r$ values may be determined.

In determining operating distance, the controller of the illustrative embodiment makes a determination of the ratio of observed microphone output levels. This ratio represents an observed value for $A_r$: $\hat{A}r$. By rewriting Eq. 36, an estimate for r as a function of the observed ratio $\hat{A}_r$ is: is:

$$\hat{r} = \frac{\hat{A}_r + 1}{\hat{A}_r - 1}d. \tag{37}$$

Eq. 37 could be implemented by the controller 6 of the illustrative embodiment in either analog or digital form, or in a form which is a combination of both. For example, the controller 6 may use a microprocessor to determine r either by scanning a look-up table (containing precomputed values of r as a function of $\hat{A}_r$), or by calculating r directly in a manner specified by Eq. 37, to provide control for analog or digital filter 5. Distance determination by the controller 6 can be performed once or, if desired, continually during operation of the PDM.

For a second order PDM, the controller 6 can use ratios in output levels between two first order PDMs (of the second order PDM) to estimate the operating distance between source and microphone. If a predetermined association is made between ratios of first order PDM output levels and operating distances at which such ratios are found to occur, an observed ratio of first order PDM output levels can be compared to the predetermined ratios at known distances to determine the then current operating distance.

Figure 9:
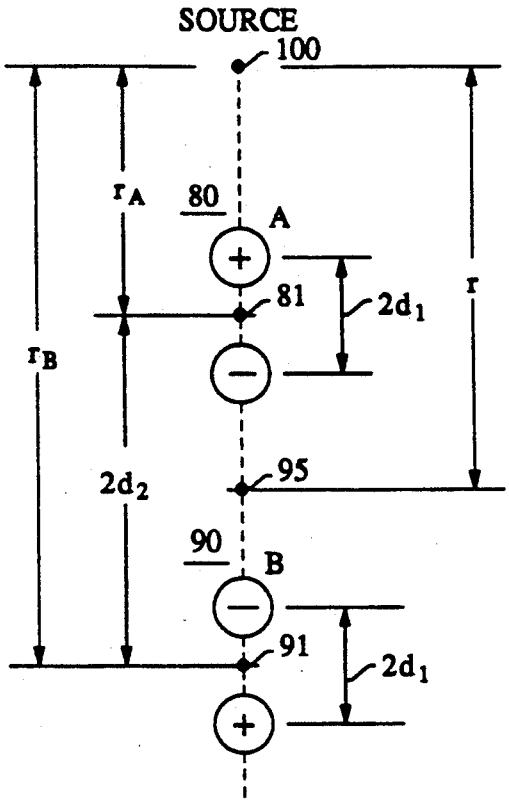
FIG. 9 presents a schematic view of a second order pressure differential microphone in relation to an on-axis point source of sound.

Consider the second order PDM which comprises first order PDMs A and B shown in FIG. 9 for $\theta=0$. The response of first order PDMs A 80 and B 90 can be written (from Eq. 10) as $$|\Delta p_A| \approx \frac{2P_0 d_1}{r_A^2 - d_1^2} \sqrt{1 + (kr_A)^2} \tag{38}$$

and $$|\Delta p_B| \approx \frac{2P_0 d_1}{r_B^2 - d_1^2} \sqrt{1 + (kr_B)^2}, \tag{39}$$

respectively, for $kd_1 << 1$, and where $r_A$ and $r_B$ are operating distances from source 100 to the acoustic centers, 81 and 91, of PDMs A and B, respectively. If the signal from each of the microphones A and B is low-pass filtered by the controller 6, then $kr_A << 1$ and $kr_B << 1$, and:

$$|\Delta p_A| \approx \frac{2P_0 d_1}{r_A^2 - d_1^2} \tag{40}$$

and $$|\Delta p_B| \approx \frac{2P_0 d_1}{r_B^2 - d_1^2}. \tag{41}$$

Since, $$r_A = r - d_2 \tag{42}$$

and $$r_B = r + d_2, \tag{43}$$

then $$|\Delta p_A| \approx \frac{2P_0 d_1}{r^2 + d_2^2 - 2rd_2 - d_1^2} \tag{44}$$

and $$|\Delta p_B| \approx \frac{2P_0 d_1}{r^2 + d_2^2 + 2rd_2 - d_1^2}, \tag{45}$$

where r is the operating distance from source 100 to the acoustic center 95 of the second order PDM.

The ratio of Eq. 44 to Eq. 45 is:

$$A_r = \frac{|\Delta p_A|}{|\Delta p_B|} \approx \frac{r^2 + d_2^2 + 2rd_2 - d_1^2}{r^2 + d_2^2 - 2rd_2 - d_1^2}. \tag{46}$$

Ratio $A_r$ is a function of operating distance r and other physical parameters of the PDM design. For a given second order PDM the parameters $d_1$ and $d_2$ are fixed such that $A_r$ varies with r only.

Figure 10:
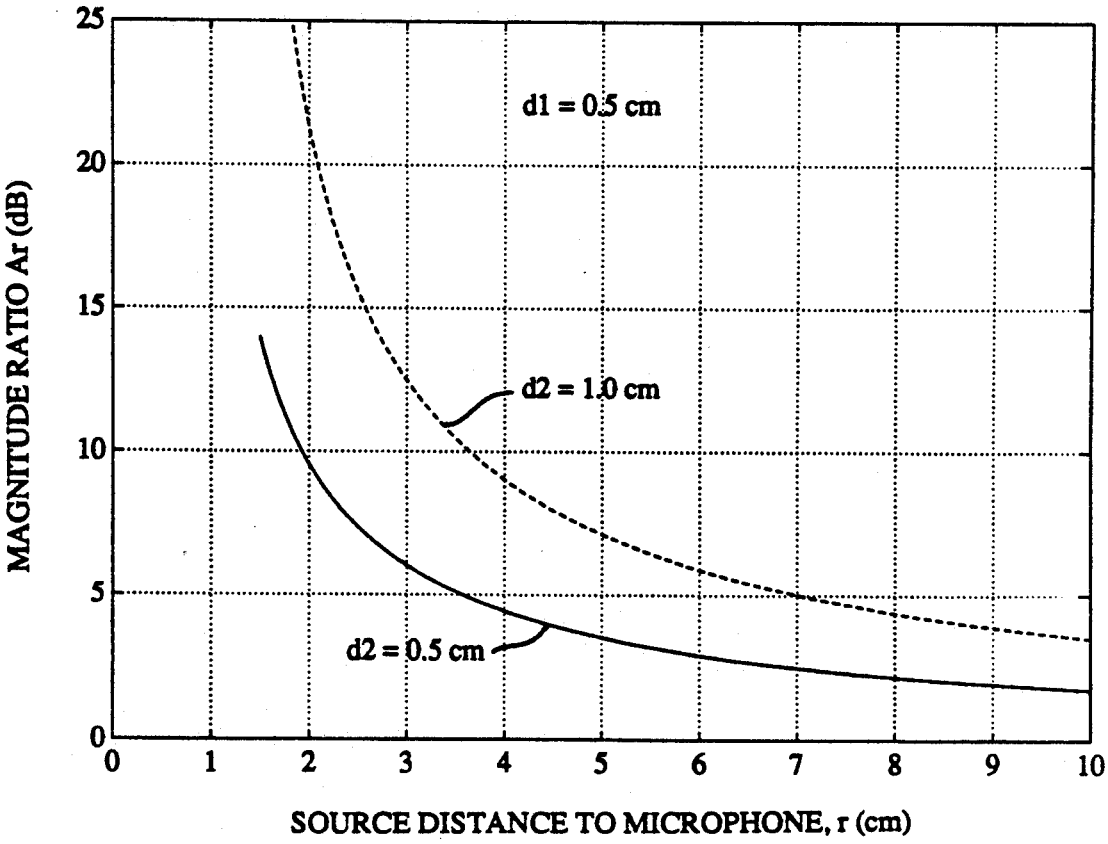
FIG. 10 presents sound pressure level ratio plots for two first order pressure differential microphones which form a second order pressure differential microphone.

A plot of $A_r$ (Eq. 46) for two exemplary second order PDM array configurations ($d_2=0.5$ cm, $d_2=1.0$ cm, and $d_1=0.5$ cm) is shown in FIG. 10. The figure shows that changes in $A_r$ are quite sizeable for the range of r. With knowledge of this data, operating distances may be determined.

In determining an operating distance, the controller 6 of the illustrative embodiment makes a determination of the ratio of observed microphone output levels (after low pass filtering). This ratio represents an observed value for $A_r$: $\hat{A}_r$. By rewriting Eq. 46, an estimate for r as a function of the observed ratio $\hat{A}_r$ is:

$$\hat{r} \approx \frac{\hat{A}_r + 1}{\hat{A}_r - 1} d_2 + \sqrt{\left(\left(\frac{\hat{A}_r + 1}{\hat{A}_r - 1}\right)^2 - 1\right) d_2^2 + d_1^2}. \tag{47}$$

As with the case above, Eq. 47 could be implemented by the controller 6 of the illustrative embodiment in either in analog or digital form, or in a form which is a combination of both. Again, distance determination by the controller 6 can be performed once or, if desired, continually during the operation of the PDM.

Regardless of which order PDM an embodiment uses, it is preferred that the controller 6 determine operating distance only when the source of sound to be detected is active. Limiting the conditions under which calibration may be performed can be accomplished by calibrating only when the PDM output signal equals or exceeds a predetermined threshold. This threshold level should be greater than the PDM output resulting from the level of expected background noise.

The low-pass filtering performed by the controller 6 on the outputs of each microphone insures that, as a general matter, only those frequencies for which the microphone's response is flat are considered for the determination of distance. This has been expressed as $kr << 1$ in the developments above. The cutoff frequency for this filter can be determined in practice by, for example, determining an outer bound operating distance and then solving for the frequency below which the microphone response is flat. Thus, with reference to FIG. 2, the frequency response of various microphones is flat for kr less than 0.5, approximately. Given an outer bound distance, $r_{OB}$, the cutoff frequency should be less than $$\frac{0.5c}{2\pi r_{OB}} \text{ (Hz.)}.$$

Filter Selection

Once distance determination by the controller 6 is performed, a filter 5 is selected. As discussed above, the filter 5 provides a frequency response which provides the desired frequency response of the PDM(n). So, for example, the combination of the microphone and a selected filter 5 may exhibit a frequency response which is substantially uniform (or flat).

In the illustrative embodiment for pressure differential microphones, filter 5 exhibits a low-pass characteristic which equals or approximates the inverse (i.e., mirror image) of PDM(n) frequency response. Such a filter characteristic may be provided by any of the known low-pass filter types. Butterworth low-pass filters are preferred for first and second order PDMs since the frequency response of a first or second order PDM exhibits a Butterworth-like high-pass characteristic.

In selecting a filter, the half-power frequency and roll-off rate of the pass band should be determined. In the illustrative embodiment, the half-power frequency, $f_{hp}$, of filter 5 should match the 3 dB gain point of the frequency characteristic of the PDM(n). Half-power frequency can be determined directly from the equation for the frequency response of the PDM(n), $|\Delta^n p|$, with knowledge of r from the distance determination procedures described above. For example, the 3 dB frequency of a first order PDM is determined with reference to Eq. 10 by solving for the value of frequency for which:

$$\sqrt{1+k^2r^2}=\sqrt{2} \tag{48}$$

(all parameters on the right hand side of Eq. 10 other than $\sqrt{1+k^2r^2}$ are constant for a given microphone configuration and therefore contain no frequency dependence). Since $$k=\frac{2\pi}{c}f,$$

an expression for the half-power frequency of the filter 5 (3 dB frequency), $f_{hp}$, as a function of distance is:

$$f_{hp}=\frac{c}{2\pi}\cdot\frac{1}{\hat{r}} \tag{49}$$

where c is the speed of sound and $\hat{r}$ is the determined distance.

For a second order PDM, the 3 dB frequency is determined with reference to Eq. 27 by solving for the value of frequency for which:

$$\sqrt{1+\frac{k^4r^4}{4}}=\sqrt{2}\,. \tag{50}$$

Since $$k=\frac{2\pi}{c}f,$$

an expression for the half-power frequency of the filter 5, $f_{hp}$, as a function of distance is:

$$f_{hp}=\frac{c}{\sqrt{2}\,\pi}\cdot\frac{1}{\hat{r}}\,, \tag{51}$$

where c is the speed of sound and $\hat{r}$ is the determined distance.

Regarding low-pass filter 5 roll-off, a rate should be chosen which closely matches (in magnitude) the rate at which the PDM high frequency gain increases. In the illustrative case of low-pass Butterworth filters for use with first and second order PDMs, this is accomplished by choosing a filter of order equal to that of the microphone (i.e., a first order filter for a first order PDM; a second order filter for second order PDM). Roll-off rate may be fixed for filter 5, or it may be selectable by controller 6.

In light of the above discussion, it will be apparent to one of ordinary skill in the art that either analog or digital circuitry could be utilized to implement the filter 5. Of course, if a digital filter is employed, additional analog-to-digital and digital-to-analog converter circuitry may be needed to process the microphone output 3. Moreover, control of an adjustable filter 5 by the controller 6 can be achieved by any of several well-known techniques such as the passing of filter constants from the controller 6 to a finite impulse response or infinite impulse response digital filter, or by the communication of signals from the controller 6 to drive voltage-controlled devices which adjust the values analog filter components. Also, the division of tasks between the controller 6 and the filter 5 described above is, of course, exemplary. Such division could be modified, e.g., to require the controller 6 to determine distance, r, and pass such information to the filter 5 to determine the requisite frequency response.

Like relative frequency response, the absolute output level of a differential microphone varies with operating distance r, as can be seen in general from the magnitude of Eq. 1, and in particular, for first and second order PDMs, from Eqs. 10 and 27, respectively. Since an estimate of operating distance is already obtained by an embodiment of the present invention for the purpose of adjusting the filter's relative frequency response, this information can be employed for the purpose of determining a gain to compensate for absolute output level variations.

The gain can be derived for any differential microphone of given order. For the illustrative embodiments previously discussed, the first and second order gain adjustment is determined as the inverse of the frequency-invariant portion of Eqs. 10 and 27, respectively. For example, if the source is located on-axis, then $\theta=0$ and $\cos\theta=1$. In this case, Eq. 10 shows that for the first order PDM, the gain would be set proportional to $$G_1=r^2-d^2. \tag{52}$$

An estimate of $G_1$, $\hat{G}_1$, can be obtained by using the estimate $\hat{r}$ previously obtained from Eq. 37, and d, a fixed design parameter. Likewise, for the second order PDM, Eq. 27 implies an on-axis gain proportional to $$G_2=(r^2-d_4^2)(r^2-d_3^2)/r, \tag{53}$$

where an estimate of $G_2$, $\hat{G}_2$, can be obtained using an operating distance estimate r obtained from Eq. 47, and where $d_3$ and $d_4$ are fixed design parameters.

Figure 11:
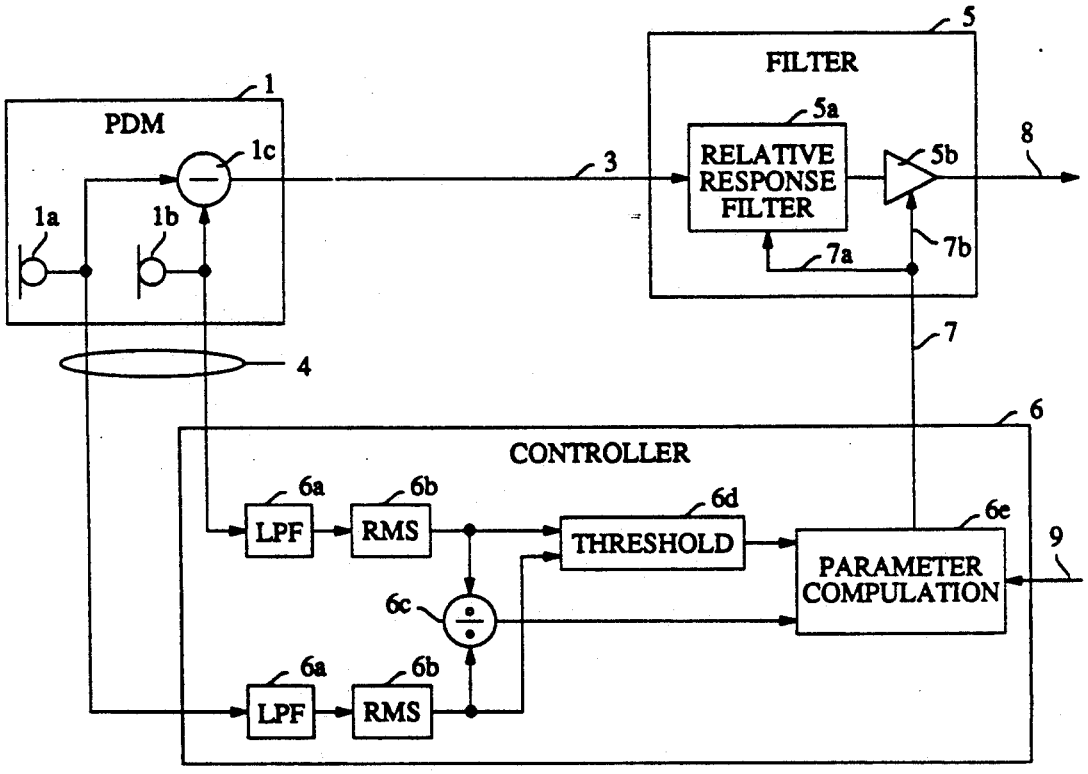
FIG. 11 presents a detailed exemplary block diagram embodiment of the present invention.

The embodiment of the present invention presented in FIG. 1 is redrawn in FIG. 11 showing additional illustrative detail for the case of a pressure differential microphone. Microphone 1 is a PDM and is shown comprising two individual microphones, 1*a* and 1*b*, which can be, e.g., two zeroth or first order PDMs. The outputs of PDMs are subtracted at node 1*c* and this difference 3 is provided to filter 5. Individual outputs 4 of the PDMs are provided to controller 6 where they are processed as follows.

Each output 4 is low-pass filtered as indicated above by low-pass filters 6a. Note this filtering implements the conditions under which Eqs. 40 and 41 were derived from Eqs. 38 and 39; this filtering is not required in the case of a first order PDM, as Eq. 36 contains no frequency components.

Next, each output has its root mean square (rms) value determined by rms detector 6b. The rms values represent the magnitude of the response of each microphone, as used in Eqs. 36 and 46. The ratio of the magnitudes as specified by Eqs. 36 and 46 is determined by an analog divider circuit 6c (a ratio may also be obtained by taking the difference of the log of such magnitudes). The output from device 6c, i.e., the observed ratio of magnitudes, $\hat{A}_r$, is provided to parameter computation 6e.

Parameter computation 6e determines control signals 7 useful to adjust the frequency response of filter 5 based on $\hat{A}_r$ in a manner according to Eqs. 37 and 49 or 47 and 51. Gain adjustment may be used in conjunction with the relative frequency response adjustment to provide additional compensation for the effects of varying operating distance as detailed in Eqs. 52 or 53. In the illustrative embodiment, the parameter computation 6e comprises analog comparators and one or more look-up tables which provide appropriate control signals 7 to one or more operational transconductance amplifiers in filter 5 to adjust its frequency response based on the value of $\hat{A}_r$.

Parameter computation 6e also receives as input an inhibit (INH) signal from threshold computation 6d which when true indicates that the output level of the PDM does not meet or exceed a threshold level of expected background noise. Thus, when INH is true, no new control signals 7 are passed to filter 5.

Parameter computation 6e further receives manual control signals 9 from a user which specify automatic one-shot (i.e., aperiodic) distance determinations, periodic determinations, or continuous determinations. To provide for periodic determinations, the parameter computation 6e includes a time base with a period which can be set with manual control signals 9. The time base signal then controls a sample and hold function which provides values of $\hat{A}_r$ to the analog comparators. Periodic distance determination by the controller 6 should be at a frequency such that the low-pass filter 5 frequency response accurately follows changes in microphone response due to movement.

In FIG. 11, filter 5 is presented as comprising a relative response filter 5a and an amplifier 5b under the control of parameter computation 6e. Signal 7a controls the relative response filter 5a. Parameter computation 6e provides control signal 7b to control the gain of amplifier 5b. The combination of filter 5a and amplifier 5b provides the overall frequency response of the filter 5.

It will be apparent to the ordinary artisan that PDM 1 can comprise several configurations in the context of an illustrative embodiment. For example, in addition to those already discussed, the PDM 1 may comprise a first order PDM and a second order PDM. In this case, constituent first order PDMs of the second order PDM can serve to supply outputs to the controller 6 for the purpose of distance determination and filter adjustment, while the first order PDM is coupled to filter 5. If PDM 1 comprises a second order PDM, itself comprising two first order PDMs, then both first order PDMs can supply output for distance determination by the controller 6, with only one supplying output filter 5. Naturally, in either case, filter 5 provides a desired response for a first order microphone, even though distance was determined with output from a second order microphone.

Other configurations are also possible. For example, if the PDM 1 comprises a first order PDM and a second order PDM, the output of the second order PDM may be provided for filtering while the outputs from constituent zeroth order PDMs of the first order PDM may be provided for distance determination by the controller 6. Also, a second order PDM 1 may comprise four zeroth order PDMs (two zeroth order PDMs in each of two first order PDMs which in combination form a second order PDM) in which case the output of all four zeroth order PDM outputs may be combined for purposes of filtering, while two outputs (of a first order PDM) are used for distance determination.

The above developments have been made in relation to a point source of sound and for pressure differential microphones. It will be apparent to one of ordinary skill in the art that parallel developments could be made for other source models and other microphone technologies, such as velocity, displacement and cardioid microphones. As a general matter, velocity and displacement differential microphones have frequency responses which relate to that of a pressure differential microphone by factors of $1/j\omega$ and $1/(j\omega)^2$, respectively, as discussed above. These factors correspond to a clockwise rotation of the frequency response characteristic of a pressure differential microphone, thereby changing the slopes of the characteristic by $-6$ dB and $-12$ dB per octave, respectively. This rotation can therefore be reflected in a filter of an embodiment of the present invention.

It will further be apparent to one of ordinary skill in the art that the present invention is applicable generally to communication devices and systems such as home, public and office telephones, and mobile telephones.

We claim:

1. A method for providing a differential microphone with a desired frequency response, the differential microphone coupled to a filter having a frequency response which is adjustable, the method comprising the steps of:

receiving one or more output signals from the differential microphone;

determining a distance between the differential microphone and a source of sound based on the received one or more output signals;

determining a filter frequency response, based on the determined distance, to provide the differential microphone with the desired response; and adjusting the filter to exhibit the determined response.

2. The method of claim 1 wherein the distance comprises an operating distance.

3. The method of claim 1 wherein one or more values of a function of the differential microphone outputs are determined at known distances and wherein the step of determining a distance comprises the steps of:

observing a value of the function based on the received one or more output signals; and comparing the observed value with the one or more determined values to determine the distance.

4. The method of claim 3 wherein the function comprises a ratio of outputs.

5. The method of claim 1 wherein the step of determining a filter frequency response further comprises the step of determining a half-power frequency of the filter based on a determined distance.

6. The method of claim 1 wherein the step of determining a distance is performed in response to a user command.

7. The method of claim 1 wherein the step of determining a distance is performed periodically.

8. The method of claim 1 wherein the step of determining a filter frequency response comprises the step of determining a substantial inverse of the frequency response of the differential microphone.

9. The method of claim 1 wherein the filter comprises a Butterworth filter.

10. The method of claim 1 wherein the step of determining a filter frequency response is performed only when the one or more output signals are produced in response to an active source of sound to be detected by the microphone.

11. The method of claim 1 wherein the filter comprises and amplifier having an adjustable gain and wherein the step of determining a filter frequency response further comprises the steps of:

determining an amplifier gain, based on the determined distance for providing the differential microphone with a desired output level; and adjusting the amplifier to exhibit the determined gain.

12. An apparatus for providing a cardioid microphone with a desired frequency response, the apparatus comprising:

an adjustable low-pass filter, coupled to the cardioid microphone; and a controller, coupled to the cardioid microphone and the low-pass filter, for adjusting the low-pass filter to provide the cardioid microphone with the desired response based on one or more signals received from the cardioid microphone.

13. An apparatus for providing a differential microphone with a desired frequency response, the apparatus comprising:

an adjustable filter, coupled to the differential microphone; and a controller, coupled to the differential microphone and the filter for determining a distance between the differential microphone and a source of sound based on one or more output signals received from the microphone and for adjusting the filter to provide the differential microphone with the desired response.

14. The apparatus of claim 13 wherein the controller comprises:

a detector for determining average values of the one or more signals received from the differential microphone; and a divider for determining a ratio of average signal values.

15. The apparatus of claim 13 wherein the filter is adjusted to exhibit a frequency response which is a substantial inverse of the frequency response of the differential microphone.

16. The apparatus of claim 13 wherein the filter comprises a Butterworth filter.

17. The apparatus of claim 13 further comprising a threshold detector for determining when a source of sound to be detected by the microphone is active.

18. The apparatus of claim 13 wherein the differential microphone comprises a pressure differential microphone and the filter comprises a low-pass filter.

19. The apparatus of claim 13 wherein the differential microphone comprises a velocity differential microphone and the filter comprises a high-pass filter.

20. The apparatus of claim 13 wherein the differential microphone comprises a velocity differential microphone and the filter comprises a band-pass filter.

21. The apparatus of claim 13 wherein the differential microphone comprises a displacement differential microphone and the filter comprises a high-pass filter.

22. The apparatus of claim 13 wherein the differential microphone comprises a cardioid microphone and the filter comprises a low-pass filter.

23. The apparatus of claim 13 wherein the filter comprises an amplifier having a gain which is adjustable by the controller based on the determined distance.

24. A microphone system comprising:

a differential microphone for providing one or more output signals;

a filter, coupled to the differential microphone and having a frequency response which is adjustable, for filtering the output signals; and a controller, coupled to the differential microphone and the filter, for determining a distance between the differential microphone and a source of sound based on the one or more output signals received from the differential microphone and for adjusting the frequency response of the filter based on the determined distance to provide a desired frequency response for the system.

25. The microphone system of claim 24 wherein the filter comprises an amplifier having a gain which is adjustable by the controller based on the determined distance.

26. A communication device comprising:

a differential microphone for providing one or more output signals;

a filter, coupled to the differential microphone and having a frequency response which is adjustable, for filtering the output signals; and a controller, coupled to the differential microphone and the filter, for determining a distance between the differential microphone and a source of sound based on the one or more output signals received from the differential microphone and for adjusting the frequency response of the filter based on the determined distance to provide a desired frequency response for the system.

27. The communication device of claim 26 wherein the filter comprises an amplifier having a gain which is adjustable by the controller based on the determined distance.

28. A method for providing a differential microphone with a desired frequency response, the differential microphone coupled to a filter having a frequency response which is adjustable, the method comprising the steps of:

receiving one or more output signals from the differential microphone;

determining a filter frequency response based on the received one or more output signals to provide the differential microphone with the desired response, wherein the determined frequency response reflects a substantial inverse of the frequency response of the differential microphone; and adjusting the filter to exhibit the determined response.

29. A method for providing a differential microphone with a desired frequency response, the differential microphone coupled to a Butterworth filter having a frequency response which is adjustable, the method comprising the steps of:

receiving one or more output signals from the differential microphone;

determining a Butterworth filter frequency response, based on the received one or more output signals, to provide the differential microphone with the desired response; and adjusting the Butterworth filter to exhibit the determined response.

30. An apparatus for providing a differential microphone with a desired frequency response, the apparatus comprising:

an adjustable filter, coupled to the differential microphone; and a controller, coupled to the differential microphone and the filter, for adjusting the filter to provide the differential microphone with the desired response based on one or more signals received from the differential microphone, the controller including a detector for determining average values of the one or more signals received from the differential microphone, and a divider for determining a ratio of average signal values.

31. An apparatus for providing a differential microphone with a desired frequency response, the apparatus comprising:

an adjustable filter, coupled to the microphone; and a controller, coupled to the microphone and the filter, for adjusting the filter to exhibit a frequency response based on one or more signals received from the differential microphone, which frequency response is a substantial inverse of the frequency response of the differential microphone, to provide the differential microphone with the desired response.

32. An apparatus for providing a differential microphone with a desired frequency response, the apparatus comprising:

an adjustable Butterworth filter, coupled to the microphone; and a controller, coupled to the microphone and the Butterworth filter, for adjusting the Butterworth filter to provide the differential microphone with the desired response based on one or more signals received from the differential microphone.

33. An apparatus for providing a pressure differential microphone with a desired frequency response, the apparatus comprising:

an adjustable low-pass filter, coupled to the pressure differential microphone; and a controller, coupled to the pressure differential microphone and the low-pass filter, for adjusting the low-pass filter to provide the pressure differential microphone with the desired response based on one or more signals received from the pressure differential microphone.

34. An apparatus for providing a velocity differential microphone with a desired frequency response, the apparatus comprising:

an adjustable high-pass filter, coupled to the velocity differential microphone; and a controller, coupled to the velocity differential microphone and the high-pass filter, for adjusting the frequency response of the high-pass filter to provide the velocity differential microphone with the desired response based on one or more signals received from the velocity differential microphone.

35. An apparatus for providing a displacement differential microphone with a desired frequency response, the apparatus comprising:

an adjustable high-pass filter, coupled to the displacement differential microphone; and a controller, coupled to the displacement differential microphone and the high-pass filter, for adjusting the frequency response of the high-pass filter to provide the displacement differential microphone with the desired response based on one or more signals received from the displacement differential microphone.

36. The apparatus of claim 13 wherein the distance comprises an operating distance.

37. The microphone system of claim 24 wherein the distance comprises an operating distance.

38. The communication device of claim 26 wherein the distance comprises an operating distance.

* * * * *